United States Patent [19]

Alexander, III

[11] 4,407,332

[45] Oct. 4, 1983

[54] WEAVERS PLATFORM ASSEMBLY AND CLOTH GUIDE

[76] Inventor: William J. Alexander, III, 41 W. Golden Strip Dr., Mauldin, S.C. 29662

[21] Appl. No.: 290,145

[22] Filed: Aug. 5, 1981

[51] Int. Cl.³ ..... D03D 49/20

[52] U.S. Cl. ..... 139/304; 242/67.1 R

[58] Field of Search ..... 66/149 R; 57/290, 291; 26/70; 242/18 R, 35.5 R, 35.5 A, 67.1 R, 67.3 R, 67.4 R; 139/291 R, 304, 309, 311

[56] References Cited

U.S. PATENT DOCUMENTS

| | | | |
|---|---|---|---|
| 3,675,868 | 7/1972 | Piattelli | 242/67.1 |
| 3,927,844 | 12/1975 | Bond et al. | 26/70 |
| 4,201,036 | 5/1980 | Schellenberg et al. | 242/35.5 |
| 4,252,154 | 2/1981 | Alexander | 139/304 |

*Primary Examiner*—Henry Jaudon

*Attorney, Agent, or Firm*—Bailey & Hardaway

[57] ABSTRACT

A weavers platform is illustrated wherein a smooth tubular roll is carried substantially along each of the sides of the platform and the like extending below a walkway portion for providing a smooth guide for sliding movement of the cloth beneath the platform for delivery from a loom to a cloth takeup positioned in front of the loom.

2 Claims, 2 Drawing Figures

WEAVERS PLATFORM ASSEMBLY AND CLOTH GUIDE

BACKGROUND OF THE INVENTION

It has long been a practice to provide a weavers platform between the loom and the cloth takeup if such is positioned in front of the loom, and especially where such is utilized in connection with an inspection frame positioned ahead of the takeup. It is common practice in connection with weavers platforms and the like, to position rotatable rolls transversely and beneath each side of the platform. The bearings for the rolls must be carried by the platform and there must be an internal core within the rolls for mounting the rolls within the bearings. Examples of the prior art weavers platforms are illustrated in U.S. Pat. Nos. 4,216,804 and 4,252,154. In addition to the expense of mounting the bearing mechanism for such rotatable rolls, such prior art rolls possess additional disadvantages in that there is a tendency for stray yarn to wrap around the guide roll members which comes off into the cloth producing seconds, as well as other disadvantages such as wrinkles. Since the bearings must be carried by the platform, it is necessary that clearance be provided for the rolls and this necessitates elevating the platform above the floor a sufficient distance for providing adequate clearance.

Accordingly, it is an important object of this invention to provide a stationary guide roll means in combination with a weavers platform so as to prevent stray yarn from wrapping around the guide members with attendant disadvantages.

Another object of the invention is to provide guide rolls for use with a weavers platform and the like which will conserve space by elimination of the bearing means so that no clearance for rotation is needed so as to permit the platform to be positioned closer to the floor.

A further advantage has been found in that very often sliding of the cloth on the smooth surface of plastic rolls permits the removal of wrinkles from the cloth. Since bearings need not be supplied, the mechanism constructed in accordance with the invention is less expensive than comparable prior art apparatus. An additional advantage is the stiffening of the platform provided by the rolls and likewise, the stiffening provided for the rolls through their connection adjacent the edges of the platform.

SUMMARY OF THE INVENTION

It is contemplated that a weavers platform be provided utilizing stationary smooth tubular members constructed preferably of plastic such as, for example, polyvinyl chloride. The tubular members are secured within marginal support portions of the platform and extend transversely between the loom and an inspection device so that the cloth may pass from the loom over the tubular members so as to pass beneath an intermediate portion of the platform, and then either directly to the takeup mechanism or over an inspection device prior to reaching the takeup. The tubular members are secured directly to upturned portions of the platform which are carried integrally by a walkway portion, and is also preferably provided with a stationary horizontal outwardly projecting flange to afford additional bearing support for the rolls.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein.

DESCRIPTION OF A PREFERRED EMBODIMENT

Figure 2:
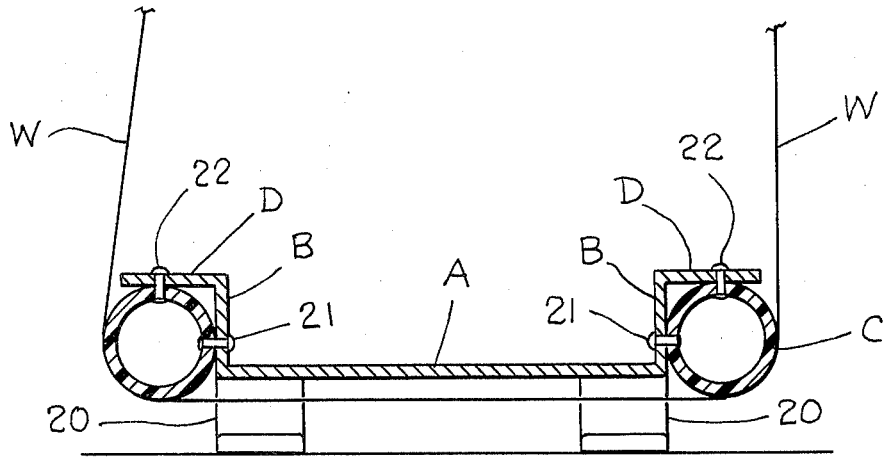
FIG. 2 is an enlarged longitudinal sectional elevation taken on line 2—2 in FIG. 1.
Figure 1:
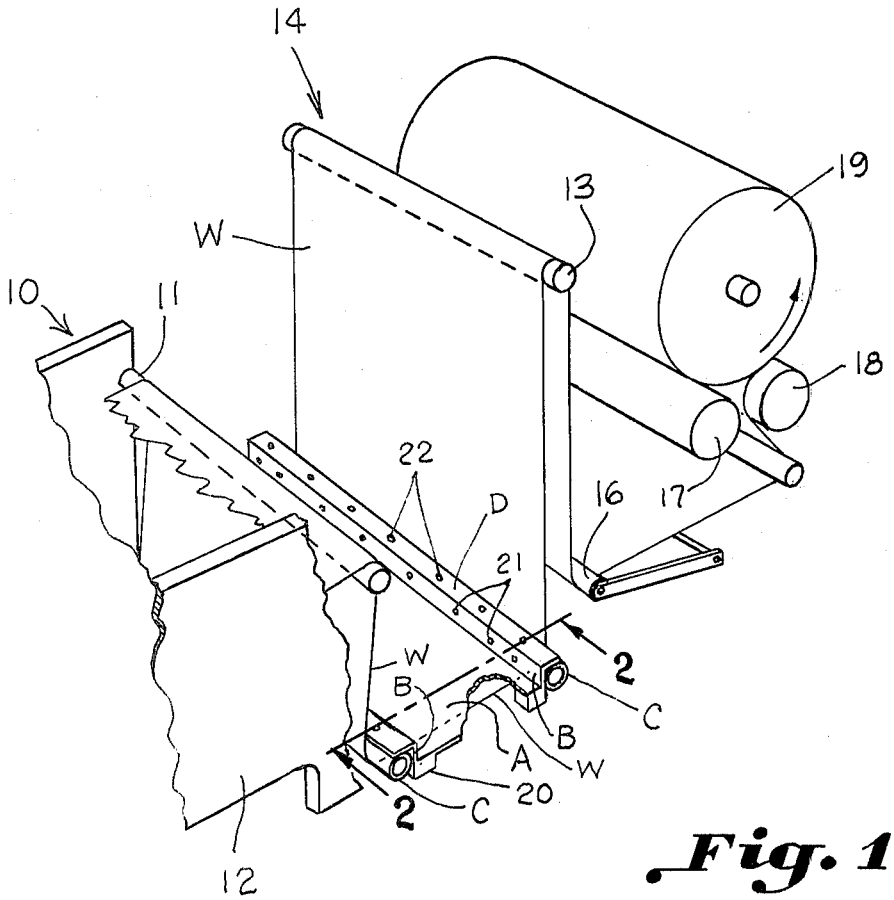
FIG. 1 is a perspective view illustrating a weavers platform constructed in accordance with the present invention between a loom and a cloth inspection device provided just ahead of a surface wound cloth takeup mechanism.

A weavers platform assembly and cloth guide for use with a loom cloth takeup for a loom is illustrated. A horizontal walkway A having sides extends transversely between the loom and the cloth takeup and has a intermediate portion between ends of the walkway in elevated position to accommodate the passage of cloth therebeneath from the loom to the takeup. An upright flange B extends along the walkway on each of the sides extending substantially entirely therealong and having integral connection with the sides. A plastic hollow tubular member C has a smooth anti-friction outer wall carried by the upright flange and has fixed connection with respect thereto. A portion of each of the hollow tubular members extends beneath the intermediate portion of the walkway over which the cloth passes for sliding guidance between the loom and the cloth takeup. An outwardly extending flange D is carried by a free upper portion of the upwardly extending flanges with the tubular members bearing upon and being fixed with respect to the respective upright and outwardly extending flange.

Referring more particularly to the drawings, the cloth in the form of a web W is illustrated as passing from a loom, broadly designated at 10, over a roll 11 which is carried between loom side frame members 12. The cloth W passes beneath the operator platform assembly and over a top roll 13 of a cloth inspection apparatus broadly designated at 14. After passing over the roll 13, the cloth web W passes over the dancer roll 16 from whence it is fed over a suitable guide roll **16*a* to driven support rolls 17 and 18 of a surface winder wherein the cloth is wound into a cloth roll 19. The weavers platform assembly is illustrated as being carried upon suitable supports or legs 20 carried for maintaining the walkway A in raised position to accommodate cloth passing therebeneath. The cloth is illustrated as passing over the downwardly extending portion of the hollow tubular members C in order to clear the walkway A and to pass between the respective supports 20 by passing under the intermediate portion of the platform or walkway A. The polyvinyl chloride tubes are connected by suitable fastening means such as bolts 21 to the upright flanges B at spaced portions. Additional fasteners in the form of bolts 22** are carried at spaced locations along the outwardly extending flanges D. Since the rolls or tubes are fixed directly to the upright flanges, no clearance for rotation being required, the platform may be positioned closer to the floor.

It is thus seen that a guide apparatus which is stationary provides a self-cleaning front surface for guiding cloth in such a manner as to strengthen the platform. The platform itself strengthens the hollow tubular members and eliminates the necessity for expensive bearings and other mounting means. If desired, the tubular members may be bowed outwardly slightly toward the middle (not shown) toward the cloth in order to enhance the ability of the rolls to remove wrinkles in the cloth.

While a preferred embodiment of the invention has been described using specific terms, such description is for illustrative purposes only, and it is to be understood that changes and variations may be made without departing from the spirit or scope of the following claims.

What is claimed is:

1. A weavers platform assembly and cloth guide for use with a cloth takeup for a loom comprising:

a horizontal walkway having sides extending transversely between said loom and said cloth takeup having an intermediate portion between ends of said walkway in elevated position to accommodate the passage of cloth therebeneath from the loom to the takeup;

an upright side flange extending along said walkway on each of said sides extending substantially entirely therealong and having integral connection with said sides;

a hollow tubular member having a smooth anti-friction outer wall carried by the upright flanges and having fixed connection with respect thereto;

a portion of said hollow tubular member extending beneath said intermediate portion of said walkway over which said cloth passes for sliding guidance between said loom and said cloth takeup; and said hollow tubular member extending outside said flanges along the entire length thereof.

2. The structure set forth in claim 1 including an outwardly extending flange carried by a free upper portion of said upwardly extending flanges, tubular members bearing upon and being fixed with respect to respective upright and outwardly extending flanges.

* * * * *